US009554682B2

(12) United States Patent
Van Der Kooi et al.

(10) Patent No.: US 9,554,682 B2
(45) Date of Patent: Jan. 31, 2017

(54) VACUUM CLEANER

(75) Inventors: Johannes Tseard Van Der Kooi, Drachten (NL); Fokke Roelof Voorhorst, Drachten (NL); Bastiaan Johannes De Wit, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 736 days.

(21) Appl. No.: 13/575,626

(22) PCT Filed: Feb. 28, 2011

(86) PCT No.: PCT/IB2011/050844
§ 371 (c)(1),
(2), (4) Date: Jul. 27, 2012

(87) PCT Pub. No.: WO2011/110971
PCT Pub. Date: Sep. 15, 2011

(65) Prior Publication Data

US 2012/0317748 A1 Dec. 20, 2012

(30) Foreign Application Priority Data

Mar. 9, 2010 (EP) ..... 10155898

(51) Int. Cl.
*A47L 9/18* (2006.01)

(52) U.S. Cl.
CPC ..... *A47L 9/188* (2013.01); *A47L 9/182* (2013.01)

(58) Field of Classification Search
CPC ..... A47L 9/188; A47L 9/182; A47L 9/18
USPC ..... 15/353
IPC ..... A47L 9/16
See application file for complete search history.

(56) References Cited

U.S. PATENT DOCUMENTS

| | | | |
|---|---|---|---|
| 5,755,096 | A | 5/1998 | Holleyman |
| 5,902,386 | A | 5/1999 | Gustafson |
| 7,210,195 | B2 | 5/2007 | Howie |
| 2004/0020004 | A1 | 2/2004 | Pogacar et al. |
| 2004/0068826 | A1 | 4/2004 | Howie et al. |
| 2004/0098958 | A1 | 5/2004 | Roth et al. |
| 2004/0237482 | A1 | 12/2004 | Lim et al. |

FOREIGN PATENT DOCUMENTS

| | | | |
|---|---|---|---|
| EP | 0053508 | B1 | 6/1982 |
| EP | 0693958 | B1 | 1/1996 |
| EP | 0890335 | A1 | 1/1999 |
| EP | 1219223 | A2 | 7/2002 |
| EP | 1475028 | A2 | 11/2004 |
| JP | 10304993 | A | 11/1998 |
| KR | 2006117000 | A | 11/2006 |

(Continued)

*Primary Examiner* — David Redding

(57) ABSTRACT

A vacuum cleaner (1) comprises an inlet (13), an outlet, a fan (14) for creating a flow of air through the vacuum cleaner (1) by drawing air to be cleaned through the inlet (13) into the vacuum cleaner (1) and by exhausting air through the outlet outwardly of the vacuum cleaner (1) and a separator (15, 41). The separator (15, 41) is rotatably arranged around an rotation axis (21), for creating, during use, a column of rotating air to separate at least a portion of the airborne particles (10) from the flow of air. The separator (15, 41) includes a number of vanes (25, 44) for the creation of the column of rotating air, wherein each vane (25, 44) is provided with a leading face (26) and a trailing face (27). The leading faces (26) of the vanes (25, 44) are inclined with respect to the rotation axis (21) for conveying the airborne particles (10) at least in an axial direction.

8 Claims, 4 Drawing Sheets

(56) References Cited

FOREIGN PATENT DOCUMENTS

WO 0162133 A1 8/2001

VACUUM CLEANER

FIELD OF THE INVENTION

The invention relates to a vacuum cleaner, comprising an inlet for receiving, during use, air to be cleaned, the air to be cleaned being laden with airborne particles, an outlet for expelling air outwardly of the vacuum cleaner, a fan for creating a flow of air through the vacuum cleaner by drawing the air to be cleaned through the inlet into the vacuum cleaner and by exhausting air through the outlet outwardly of the vacuum cleaner and a separator rotatably arranged around an rotation axis, for creating, during use, a column of rotating air to separate at least a portion of the airborne particles from the flow of air, which separator includes a number of vanes for the creation of the column of rotating air, wherein each vane is provided with a leading face and a trailing face.

BACKGROUND OF THE INVENTION

Such a vacuum cleaner is known from U.S. 2004/0068826 A1. By the vacuum cleaner disclosed in U.S. 2004/0068826 A1 air with airborne particulates and water droplets are being moved from the air inlet opening to the separator. The separator includes a cup shaped body having a bottom and a wall, further defined by a plurality of vanes extending upwardly from the bottom to an open top. The vanes comprise a curved flow surface for increased particulate separation and reductions in aerodynamic losses. The vanes extend longitudinally with respect to a body and are generally tapered radially relative to a rotation axis of the separator like an air foil. The curved flow surface extends along the length of each of the vanes. The separator comprises vanes to force the air and the airborne particulates to rotate about the rotation axis of the separator. Due to centrifugal forces the airborne particulates will be moved away from the vanes. The longitudinally extending vanes define a plurality of longitudinal gaps or openings, formed there between. Fluid and particulates are drawn into the exterior of the separator via the gaps. As the particulates are drawn in, the separator, which is being rotated at a relatively high angular velocity, applies a centrifugal force to the particulates and to the air and water. The particulates are forced outwardly of the separator body where they can be expelled back into a water bath. Cleaned air is then exhausted from the separator through an outlet.

EP 1219223 A2 discloses a liquid-assisted suction cleaner with a separator rotating at high speed, of a truncated-cone shaped structure formed of a number of radial helical vanes, slightly concave externally, whose width and thickness decrease from a thick ring, forming the greater base, to the smaller base with a flat bottom, said vanes being held firm by an internal ring, said separator being preferably constructed in one single piece of plastic material, balanced by adjustment, in the die used to mould it, of the depth of cavities made in the thick ring and in the bottom, a coat of epoxy paint being applied inside and outside to prevent formation of humid areas that would lead to variations in dimensions that in turn would be the cause of vibrations.

EP 0890335 A1 discloses separator unit for liquid bath vacuum cleaners used for separating from the introduced air the particles of dirt and/or dust sucked with drops of water, the separator unit comprising at least a hollow body shaped like a truncated cone assembled on the drive shaft of the intake assembly of the vacuum cleaner, the hollow body including laterally a plurality of longitudinal slits to discharge the introduced particles of dirt/dust and/or drops of liquid, the separator unit comprising a disk-shaped supporting element axially holed and keyed onto the drive shaft, the supporting element being coupled with the hollow body by means of a peripheral edge with a tooth to couple with the upper edge of the hollow body, the supporting element including a plurality of radial apertures for the passage of the ingested air and a plurality of discharge slits made radially on the portion of the peripheral edge which defines the tooth.

U.S. 2004/098958 A1 discloses a separator for a wet vacuum cleaner has a bottom and a sidewall connected to the bottom. The sidewall has lamellas delimiting slots, wherein through the slots an air/gas flow enters an interior of the separator, delimited by the bottom and the sidewall, wherein the air/gas flow contains dirt/dust particles and/or water droplets. The lamellas each have at least one radial outer widened section, extending in a rotational direction of the separator, and at least one remaining lamella section, wherein the at least one radial outer widened section and the at least one remaining lamella section delimit together a turbulence chamber, respectively. In view of today's requirements in the field of sustainability there is a call for low-energy or energy-saving devices. As a result of this there is a continuous ambition to improve on the energy consumption of domestic appliances such as vacuum cleaners.

SUMMARY OF THE INVENTION

It is an object of the invention to provide a vacuum cleaner of the above mentioned kind having improved separation efficiency.

This object is achieved by the vacuum cleaner according to the invention in that the leading faces of the vanes are inclined with respect to the rotation axis for conveying the airborne particles at least in an axial direction to a zone of a reduced proportion between drag forces versus centrifugal forces.

Before exhausting the air to the outside of the vacuum cleaner again, the flow of air is subjected to the action of the separator to separate as much as possible the airborne particles or particulates in the flow of air from the air in order to clean the air. The air having a low specific mass is dragged into the separator by the vacuum generated by the turbine or fan. The airborne particles are also dragged towards the separator along with the air into which they are airborne. In the vicinity of the separator the airborne particles enter into a column of rotating air caused by the high-speed rotation of the separator. On top of the drag forces which convey the particles towards the separator and into the column of rotating air, the airborne particles are being subjected to centrifugal forces due to the action of the column of rotating air. Hence, in the column of rotating air the airborne particles are on the one hand subjected to centrifugal forces which tend to expel the particles away from the separator and on the other hand subjected to drag forces which tend to take the airborne particles into and through the separator. There is a balance between the drag forces and the centrifugal forces by virtue of which the separation process works and specifically its efficiency is determined.

If the drag forces on an airborne particle outweigh the centrifugal forces on said particle, the particle enters the separator, thereby harming the overall separation efficiency. Vice versa, if the centrifugal forces outweigh the drag forces the airborne particle is thrown out of the column of rotating air without flowing through the separator, thereby resulting to a successful separation and to an increase of the separation efficiency.

The separator is equipped with a number of vanes which convey the air when it enters the separator. If a trajectory of an air molecule flowing into the separator, i.e. a flow line, is considered, a distinction can be made between the so-called leading face and trailing face of the vane. This leads to a side or part of the vane that first approaches the air flowing along a flow line when the separator is rotating; this side is referred to as the leading face of the vane. As the air continues its path around the vane it will subsequently reach the other side of the vane which is referred to as the trailing face of the vane. The leading face of a vane is the edge or side of the vane which faces the air that flows towards the separator and the vane; the trailing face of a vane is the rearmost edge or side of the moving vane as seen in the direction of the airflow. A direction which is parallel to the rotation axis of the separator is referred to as "axial direction".

As explained above the balance between drag forces and centrifugal forces on the airborne particles lays down the separation efficiency. In axial direction, this balance between the drag and centrifugal forces generally varies. For example, the separator may have a proximal side which is close to the fan and a distal side which is remote from the fan. In such a configuration a possible flow pattern which emanates from the fan and separator is known as a so-called flow sink. In such a flow sink the drag forces close to the fan are relatively high compared to the drag forces at the distal end of the fan, whereas the centrifugal forces show less variation in axial direction. In the context of such a flow sink an important phenomenon is that the velocities of air volumes which are close to the fan are relatively high compared to the velocities of air volumes which are at a relatively large distance from the fan. As a consequence the drag forces are relatively high close to the fan compared with the drag forces at a larger distance from the fan. The magnitude of drag forces approximately scale with the reciprocal value of the squared air velocity. Hence in a zone of reduced proportion of drag forces versus the centrifugal forces, the balance between drag forces and centrifugal forces is in favor of the centrifugal forces, which is advantageous for the separation efficiency. With this result of improved separation efficiency in mind the invention recognizes that it is advantageous to guide the airborne particles to a zone of a reduced proportion between the drag forces versus the centrifugal forces. This is accomplished by the vacuum cleaner according to the invention in that the leading face is at an inclination to force the air and the particles thereon in axial direction, parallel to the direction of the rotation axis, preferably to a zone of reduced drag forces in relation to the centrifugal forces where the drag forces are more easily defeated by the centrifugal forces on said particles. In this manner also relatively small and light particles can be separated from the flow of air. The improved separation efficiency may be realized without increase of the rotational speed of the separator.

A separator may be formed from a rigid material such as glass filled polystyrene material, and the like, and may be injection moulded. Normally a draft angle is imposed on a moulded component of the separator to provide ability to release the moulded component from its mould. This draft angle is created by decreasing the thickness of the vanes in axial direction. The thickness of a vane is the distance between a first point on the leading face and a second point on the trailing face of the vane, the first and second point being positioned at the same radial distance from the rotation axis. The draft angle is determined by a difference of the inclination between the leading face and the trailing face. Such a draft angle is not sufficient to create the envisaged effect of conveying or forcing the airborne particles in axial direction. Contrary thereto, the inclination of the leading face which is required to force the particles into the axial direction and which is required to significantly increase the separation efficiency according to the invention exceeds the value of the draft angle. Alternatively, the tangent of the angle of inclination of the leading face is larger than the ratio between the material thickness and the length of the vane in axial direction to obtain the envisaged separation efficiency.

The statement "the leading faces of the vanes are inclined" does not exclude the existence of non-inclined point(s) at the leading faces of the vanes, and therefore refers to "at least portions of the leading faces of the vanes are inclined".

In an embodiment of the vacuum cleaner according to the invention, the leading face has a first portion and a second portion, wherein the first portion is inclined in a positive direction and the second portion is oppositely inclined in a negative direction, said positive and negative directions being opposite directions, for guiding airborne particles at least in corresponding opposite axial directions.

The purpose of forcing the particles in axial direction is to convey the airborne particles to a zone of a favorable ration between drag and centrifugal forces, i.e. a zone of improved separation efficiency. By providing a first and a second portion, each inclined in different directions, the flow of air which approaches the leading face will either be split and directed towards two efficient zones or be concentrated and directed to one efficient zone. This shortens the length of path in axial direction that the airborne particles have to abridge to arrive in an efficient separation zone. If the efficient zone is axially near the middle of the vane, the airborne particles should be forced towards the middle. If the efficient zones are axially near the ends of the vanes, the flow should be split up and conveyed towards the efficient zones near the ends of the blades.

In a very advantageous embodiment of the vacuum cleaner according to the invention, the fan is coaxially arranged with the separator, each vane having a proximal and a distal end, the proximal ends being between the fan and the distal ends, wherein the leading faces are inclined with respect to the rotation axis in a direction for guiding airborne particles towards the distal ends.

Axially away from the fan the ratio between drag forces and the centrifugal forces is significantly smaller than axially close to the fan. By the inclination of the leading faces a counter airflow is generated that helps to prevent airborne particles such as dust and dirt from penetrating through the separator end entering, dirtying or even damaging other vacuum cleaner compartments and components.

In another embodiment of the vacuum cleaner according to the invention, the separator comprises at least one plate extending perpendicular to the rotation axis, the vanes being arranged on at least one side of the plate, wherein the leading faces of the vanes are inclined for conveying the airborne particles in axial direction towards the plate.

At such a plate additional forces on top of the drag and centrifugal forces will be exerted to the air by the surface of the air. Thus the surface of the plate and the boundary layer of air which is close to the surface will provide an extra pumping effect or pumping force which counteracts the drag forces and helps the centrifugal forces emanating from the column of rotating air. Air will stick to the surface of the plate. The combination of centrifugal forces and pumping forces, i.e. the forces caused by the extra pumping effect, can more easily outweigh the drag forces than the centrifugal forces alone so that the airborne particles will be thrown out of the column of rotating air more effectively resulting to an even more successful separation. Since the plate has two sides, vanes can be arranged on both sides, the pumping effect can be provided for both the vanes which are axially above the plate and for the vanes which are axially below the plate. Thereto the inclinations of the vanes above the plate may be such as to force the airborne particles down towards the top surface of the plate and the inclinations of the vanes below the plate may be such as to force the airborne particles upwards to the bottom surface of the plate.

In a further embodiment of the vacuum cleaner according to the invention the separator comprises two plates extending perpendicular to the rotation axis, which plates are connected to opposite axial ends of the vanes, wherein the opposite axial directions extend towards the opposite axial ends.

With such an embodiment, near each axial end of each vane relatively small particles can easily be moved away from the separator. The two plates and the vanes there between form a composition of a segment. If two or more of such segments are axially built together a segmented separator is obtained with a corresponding multitude of zones of increased separation efficiency. In such a segmented set-up of the separator the axial length of the flow paths, i.e. the lengths of the paths which is needed to bring the particles to a zone of improved separation efficiency, can be considerably reduced.

In yet another embodiment of the vacuum cleaner according to the invention the plate has a radius, which radius is larger than the maximum distance between of a tip of the vanes and the rotation axis.

During rotation of the separator, an air flow will be created over the plate which counteracts the airflow into the separator and will cause a force extending away from the rotation axis, which force will be supplementary to the centrifugal forces. The larger the plate is, the larger the force extending away from the rotation axis will be.

In another embodiment of the vacuum cleaner according to the invention, at least in one plane perpendicular to the rotation axis, each vane is curved from an inner edge to an outer edge in a direction opposite to the direction of rotation, wherein the inner edge is located closer to the rotation axis than the outer edge.

Due to the so curved vanes, particles on the front side of the vanes will be forced by the vanes away from the rotation axis.

In another embodiment of the vacuum cleaner according to the invention, the vanes have a portion which is helically arranged.

Such vanes can easily be produced because the angle at which the leading faces are inclined with respect to the rotation axis is constant along the length of the vane in axial direction, i.e. the axial length of the vane.

In another embodiment of the vacuum cleaner according to the invention, the inclined vane has an angle with respect to the rotation axis, which angle varies along the length of the vane in the axial direction into which the airborne particles are being forced by the inclined vanes.

By applying a varying inclination angle the tendency of airborne particles to move in axial direction can be adapted to their axial position at which they approach the separator. Particles which are already near a separation efficient zone do not need as much axial displacement as particles which are relatively far away from the separation efficient zones. Hence by applying a varying inclination angle the overall separation efficiency may be tuned and further improved.

BRIEF DESCRIPTION OF THE DRAWINGS

The invention will be explained in more detail with reference to the drawings, in which.

Like parts are indicated by the same reference numbers in the figures.

DETAILED DESCRIPTION OF EMBODIMENTS

Figure 6:
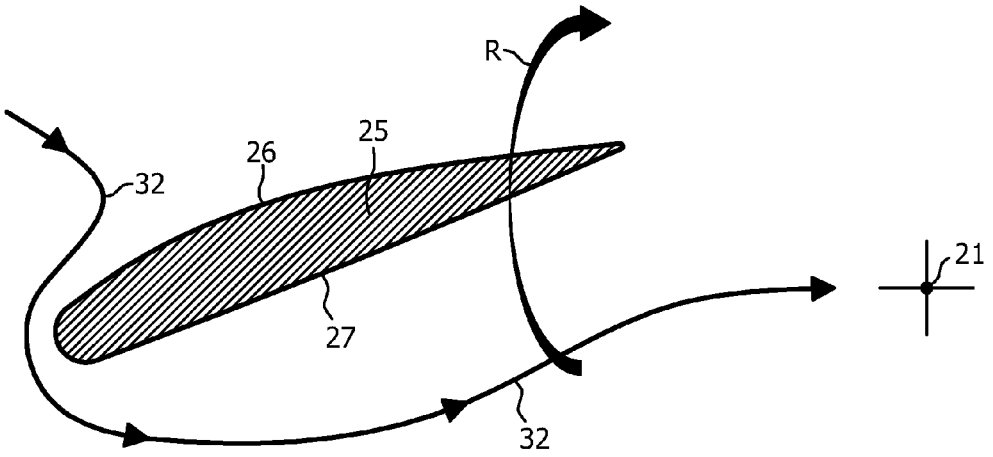
FIG. 6 is a schematic representation of a vane.

In FIG. 6 a cross-section of a vane 25 of a separator 15 is schematically depicted. The vane 25 is rotating in a clockwise direction around an axis of rotation 21 of the separator 15. The direction of rotation is indicated by a curved arrow R. A practical embodiment of the separator 15 is in general equipped with a number of such vanes; however, in FIG. 6 only one vane is depicted. If a trajectory 32 of an air molecule flowing into the separator, i.e. a flow line, is considered, a distinction can be made between a so-called leading face 26 and trailing face 27 of the vane 25. This leads to a side or part of the vane that first approaches the air flowing along flow line 32 when the separator is rotating; this side is referred to as the leading face of the vane. As the air continues its path around the vane it will subsequently reach the other side of the vane which is referred to as the trailing face 27 of the vane. The leading face 26 of a vane is the side of the vane which faces the air that flows towards the separator and the vane; the trailing face 27 of a vane is the rearmost side of the moving vane as seen in the direction of the airflow.

Figure 1:
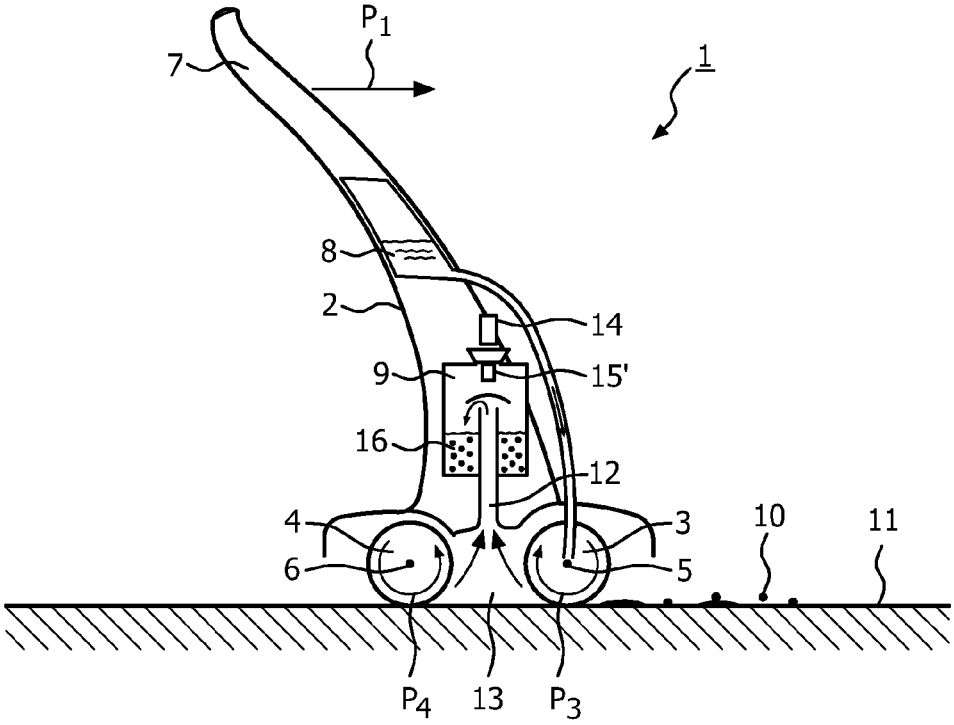
FIG. 1 is a schematic cross section of a vacuum device according to the invention.

FIG. 1 shows a vacuum cleaner 1 comprising a housing 2 in which two brushes 3, 4 are rotatably mounted around axles 5, 6. The brushes 3, 4 are driven by a motor (not shown). The brush 3 is rotatable in a clockwise direction, indicated by arrow P3 and the brush 4 is rotatable in a counter clockwise direction, indicated by arrow P4 around the respective horizontal axles 5, 6. The brushes 3, 4 are fully enclosed except at the bottom by the housing 2. The housing 2 is provided with wheels (not shown) keeping the axles 5, 6 at a predetermined distance of the surface to be cleaned. The housing 2 is provided with a handle 7 at a side remote of the brushes 3, 4. Between the handle 7 and the brushes 3, 4 the vacuum cleaner 1 is provided with a reservoir 8 for a cleansing fluid like water and a debris collecting container 9 for fluid and particles 10 picked up from the surface 11 to be cleaned. The debris collecting container 9 is provided with a hollow tube 12 extending from an air inlet opening 13 between the brushes 3, 4 into the debris collecting container 9. At a side of the debris collecting container 9 opposite the tube 12 there is provided a vacuum fan 14 and a rotatable separator 15.

In use, the vacuum cleaner 1 is being moved in a direction as indicated by arrow P1 over the surface to be cleaned 11.

During said movement, the brushes 3, 4 are being rotated in the opposite directions P3, P4 directed towards each other near the surface to be cleaned 11. Cleansing fluid from the reservoir 8 is applied via the brush 3 on the surface 11. By moving the brushes 3, 4 over the surface to be cleaned 11 particles like dirt and other materials are being disconnected from the surface 11. Simultaneously, the surface 11 is being cleaned by the cleansing fluid. By further moving the vacuum cleaner 1 in the direction as indicated by arrow P1, the disconnected particles 10 and the cleansing fluid on the surface are being moved upwards into the air inlet opening 13 due to the rotational movement of the brushes 3, 4, i.e. the fluid and particles 10 picked up from the surface 11 to be cleaned will become airborne. Furthermore, the air with the airborne particles 10 and cleansing fluid is being moved from the air inlet opening 13 into the tube 12 towards the debris collecting container 9 by means of the vacuum fan 14. In the debris collecting container 9 most of the particles will fall directly downwards towards the bottom of the debris collecting container 9 into dirty fluid 16 that has already been picked up or that was already present in the container 9. Instead of falling directly to the bottom of the container 9 there are also particles that tend to move towards the vacuum fan 14. These particles that tend to move upwards to the fan 14 are prevented there from by the separator 15 which acts counterproductive to the vacuum fan 14. The relatively heavy particles will be moved away from the separator 15 and will fall downwards into the dirty fluid 16. The relatively light air will pass the separator 15 and be moved through the vacuum fan 14 and the cleaned air will leave the vacuum cleaner via an air outlet opening.

Figure 2:
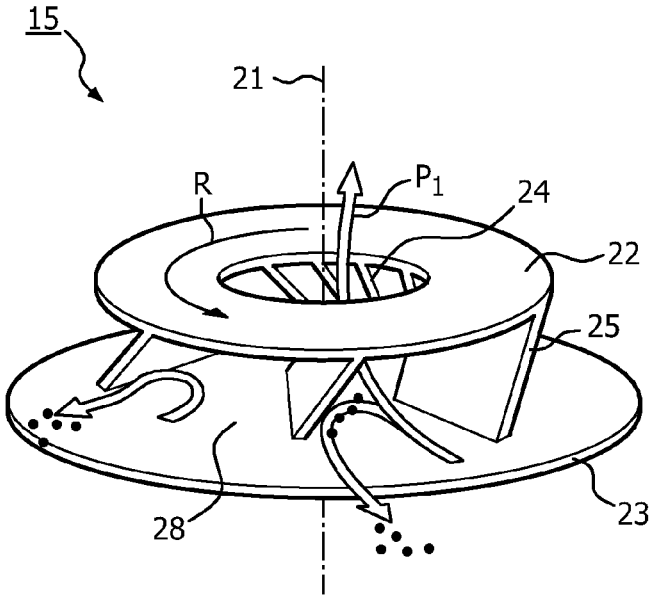
FIG. 2 is a schematic perspective view of a separator of the vacuum device as shown in FIG. 1.
Figure 3:
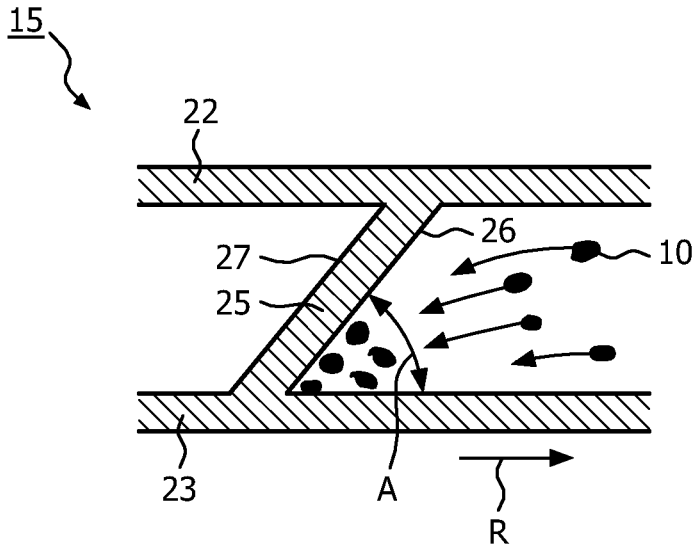
FIG. 3 is an enlarged side view of a part of the separator as shown in FIG. 2, FIGS. 4A and 4B are enlarged bottom views of a part of the separator as shown in FIG. 2.
Figure 4A:
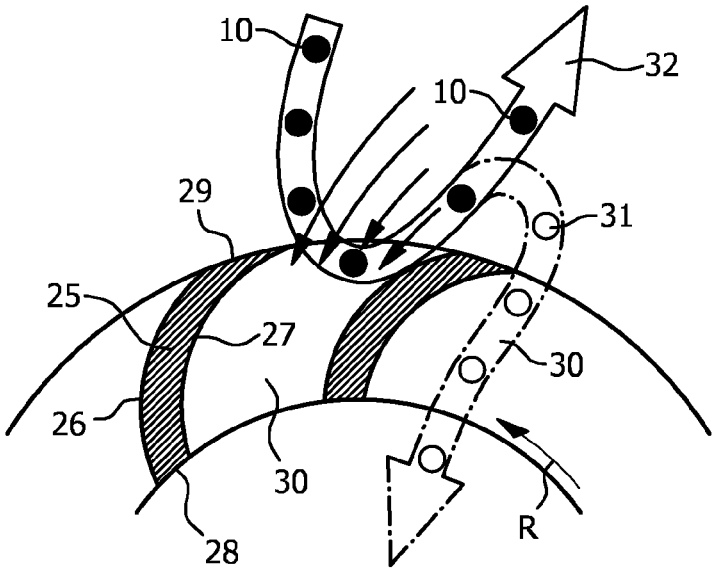
Figure 4B:
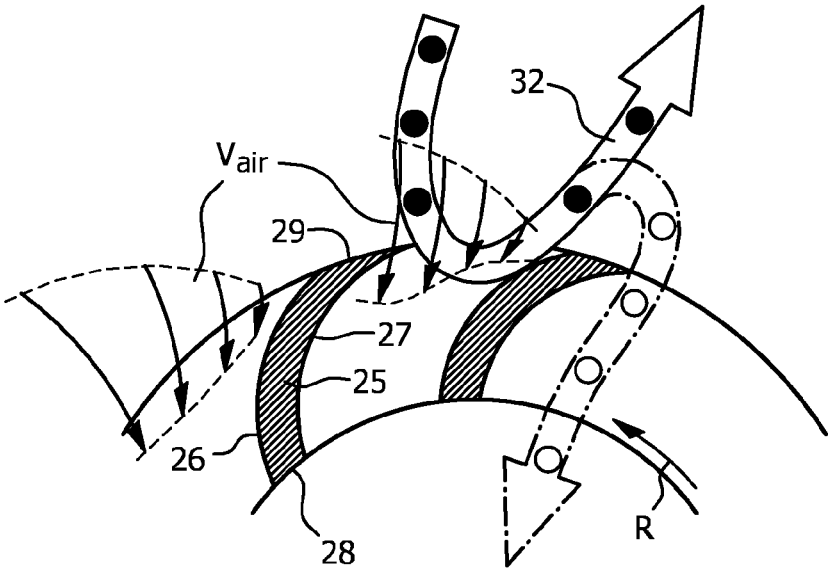

FIGS. 2-4B show different views of the separator 15 being rotatable about a rotation axis 21. The separator 15 comprises two round plates 22, 23 having different diameters. The central axis of the plates 22, 23 forms the rotation axis 21. The plate 22 is of a smaller diameter than plate 23 and is provided with a centrally located hole 24. This plate 22 is located closer to the vacuum fan 14 than the plate 23. The plates 22, 23 are located at a distance of each other and are connected to each other by means of vanes 25. Each vane 25 has a leading face 26 and a trailing face 27 seen in the rotation direction R (FIGS. 2, 4A, 4B). As can be seen in FIG. 3, the vanes 25 are inclined with respect to the rotation axis 21 and the leading face 26 encloses an angle A with the plate 23. Each vane 25 is curved from an inner edge 28 to an outer edge 29 in a direction opposite to the rotation direction R, wherein the inner edge 28 is located closer to the rotation axis 21 than the outer edge 29. Between the vanes 25 passages 30 are present through which air will flow from the debris collecting container 9 towards the vacuum fan 14 in a direction as shown by arrow P1 (FIG. 2).

When rotating the separator 15 about the rotation axis 21 in the rotation direction R, a column of rotating air will be created by the high-speed rotation of the separator 15. The air having a low specific mass compared to the dirt and particles which are airborne therein is dragged into the separator 15 by drag forces caused by the vacuum generated by the vacuum fan 14. The airborne particles are also dragged towards the separator 15 along with the air into which they are airborne. In the vicinity of the separator 15 the airborne particles enter into the column of rotating air. On top of the drag forces which convey the particles towards the separator 15 and into the column of rotating air, the airborne particles are being subjected to centrifugal forces due to the action of the column of rotating air.

In FIG. 4B, a relative velocity profile $v_{air}$ of air and airborne particles in the passage 30 between a trailing face 27 of one vane 25 and the leading face 26 of another vane 25 is indicated relative to the vane 25. As will be appreciated by the skilled person this velocity is relative to the trailing face because the vanes are rotating at high angular velocity. As can be seen, the velocity at the leading face 26 is much smaller than at the trailing face 27.

In FIGS. 4A and 4B a trajectory 32 of an air molecule 31 flowing into the separator 15 is shown. After being lead to the leading face 26, the air molecule 31 will flow around the outer edge 29 towards the trailing face 27. It will then flow through the passage 30 and through the hole 24 (FIG. 2) towards the vacuum fan 14. A heavier airborne particle 10 will be subjected to the drag forces and the centrifugal forces. If the centrifugal forces outweigh the drag forces the airborne particle 10 is thrown out of the column of rotating air without flowing through the separator 15. The heavier particle 10 will follow the trajectory 32 towards the leading face 26 and away there from.

Due to the curvature of the vanes 25 from the inner edge 28 to the outer edge 29 in a direction opposite to the rotation direction R, the leading faces 26 will also exert a pushing force on the particles 10 in a direction away from the rotation axis 21. A vane having this effect is known as a so-called non-catching vane.

As can be seen in FIG. 3, the particles 10 will be directed by the inclined leading faces 26 of the vanes 25 in axial direction towards the plate 23 which is located further away from the vacuum fan 14 than the plate 22. Near the plate 23 the drag forces are lower than near the plate 22. Furthermore, the rotating plate 23 with the larger diameter will create a pumping effect on the air near the plate 23 in a direction away from the rotation axis 21. Due to the pumping effect, a pumping force will be exerted on the air and the airborne particles 10. This pumping effect counteracts the drag forces and helps the centrifugal forces emanating from the column of rotating air. Near the plate 23 the combination of centrifugal forces and pumping forces can easily outweigh the drag forces, so that also relatively light airborne particles will be thrown out of the column of rotating air down to the dirty water in the container 9 resulting into a successful separation.

Figure 5:
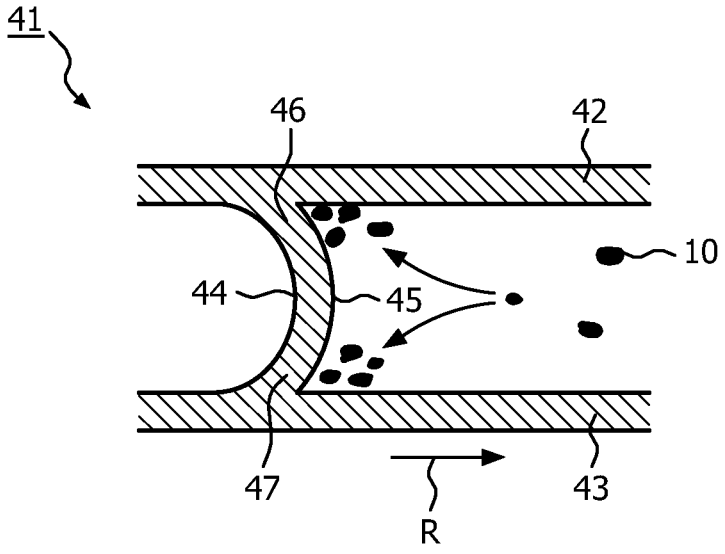
FIG. 5 is an enlarged side view of a part of a separator of another embodiment of the vacuum device according to the invention.

FIG. 5 shows a side view of a separator 41 of another embodiment of a vacuum cleaner according to the invention. The separator 41 comprises two plates 42, 43 and vanes 44 extending between the plates 42 and 43. Both plates 42 and 43 have a radius larger than the radius of the vanes 44. The vanes 44 are curved in a plane perpendicular to the rotation axis to provide the non-catching effect as described above according to a previous embodiment. The vanes 44 are also curved in a plane parallel to the rotation axis, as can be seen in FIG. 5. The curvature in the plane parallel to the rotation axis is such that the leading face 45 has a first portion 46 and a second portion 47, which are inclined in a positive direction and a negative direction respectively. Said positive and negative directions are opposite directions. Particles 10 are guided by either the first portion or the second portion of the leading face 45 of the vane 44 in opposite axial directions towards the plates 42, 43.

It is also possible to use plates which have a shape other than round. However, given the fact that the separator has to provide separation at high angular velocities the plates should preferably not introduce too much unbalance.

It is also possible to provide a number of separators 15 on top of each other wherein the centrally located hole 24 extends through all the plates except the plate directed towards the debris collecting container 9 to prevent air and airborne particles to directly enter hole 24.

Other variations to the disclosed embodiments can be understood and effected by those skilled in the art in practicing the claimed invention, from a study of the drawings, the disclosure, and the appended claims. In the claims, the words like "comprising" and "having" do not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A vacuum cleaner, comprising:

an inlet for receiving air to be cleaned, said air including airborne particles;

an outlet for expelling received air externally of the vacuum cleaner;

a fan for producing a flow of air through the vacuum cleaner by drawing the air to be cleaned through the inlet into the vacuum cleaner and by exhausting air through the outlet; and a separator rotatably arranged around a rotation axis for, during operation, producing a column of rotating air for separating at least a portion of the airborne particles from the flow of air, the separator including a plurality of vanes for producing the column of rotating air, each of said vanes having a leading face and a trailing face, where the leading faces of the vanes are inclined with respect to the rotation axis for conveying the airborne particles along a path that is at least partially in an axial direction and leads to a zone where a ratio of drag forces tending to guide the airborne particles into the separator relative to centrifugal forces tending to expel said airborne particles away from the separator is smaller than said ratio outside of said zone and where each leading face has a first portion and a second portion, said first portion being inclined in a positive direction and said second portion being oppositely inclined in a negative direction, for guiding airborne particles along said path.

2. A vacuum cleaner according to claim 1 where the fan is coaxially arranged with the separator, each vane having a proximal and a distal end, the proximal ends being between the fan and the distal ends, and where the leading faces are inclined with respect to the rotation axis in a direction for guiding airborne particles towards the distal ends.

3. A vacuum cleaner according to claim 1 where the separator comprises at least one plate extending perpendicular to the rotation axis, the vanes being arranged on at least one side of the plate, and where the leading faces of the vanes are inclined for conveying the airborne particles in an axial direction towards the plate.

4. A vacuum cleaner according to claim 1 where the separator comprises first and second plates extending perpendicular to the rotation axis, said plates being connected to opposite axial ends of the vanes, and where the opposite axial directions extend towards the opposite axial ends.

5. A vacuum cleaner according to claim 3 where the at least one plate has a radius, said radius being larger than a maximum distance between a tip of the vanes and the rotation axis.

6. A vacuum cleaner according to claim 1 where, in at least one plane perpendicular to the rotation axis, each vane is curved from an inner edge to an outer edge in a direction opposite to the direction of rotation and where the inner edge is located closer to the rotation axis than the outer edge.

7. A vacuum cleaner according to claim 1 where each of the vanes has a portion that is helically arranged.

8. A vacuum cleaner according to claim 1 where each inclined leading face has an angle with respect to the rotation axis, said angle increasing along a length of the leading face in the axial direction into which the airborne particles are forced by the inclined faces.

* * * * *